US005483942A

United States Patent [19]

Perry et al.

[11] Patent Number: 5,483,942

[45] Date of Patent: Jan. 16, 1996

[54] FUEL VAPOR LEAK DETECTION SYSTEM

[75] Inventors: Paul D. Perry; John E. Cook, both of Chatham, Canada

[73] Assignee: Siemens Electric Limited, Chatham, Canada

[21] Appl. No.: 393,952

[22] Filed: Feb. 24, 1995

[51] Int. Cl.[6] ..... F02M 33/02

[52] U.S. Cl. ..... 123/520; 123/198 D

[58] Field of Search ..... 123/516, 518, 123/519, 520; 73/117.3, 118.2

[56] References Cited

U.S. PATENT DOCUMENTS

| | | | |
|---|---|---|---|
| 5,263,461 | 11/1993 | Fujimoto et al. | 123/520 |
| 5,299,544 | 4/1994 | Kitamoto et al. | 123/520 |
| 5,390,645 | 2/1995 | Cook et al. | 123/520 |

*Primary Examiner*—Thomas N. Moulis

[57] ABSTRACT

Differential flow sensing through respective flow path portions of a system for detecting leakage from an evaporative emission control system. A series flow path comprises a first flow sensor for sensing the entire output flow of an impeller pump used to positively pressurized the system under test, a second sensor in a portion of the series flow path that is downstream of the first flow sensor, and a calibrated orifice downstream of the second flow sensor. A branch circuit to the evaporative emission space under leakage test tees into the aforementioned series circuit between the first flow sensor and the second flow sensor. A differential amplifier receives signal from the respective sensors. Any difference in sensed flows, once the pressure has been brought to a predetermined pressure, is output by the differential amplifier to signify leakage in an amount correlated with the sensed difference in the flows.

11 Claims, 1 Drawing Sheet

FUEL VAPOR LEAK DETECTION SYSTEM

REFERENCE TO A RELATED APPLICATION

In certain respects this is an improvement on the inventors' prior application entitled "Fuel Vapor Leak Detection System", Ser. No. 08/205,983, filed Mar. 4, 1994, now U.S. Pat. No. 5,390,645, issued Feb. 21, 1995.

FIELD OF THE INVENTION

This invention relates to an on-board system for detecting fuel vapor leakage from an evaporative emission control system of an automotive vehicle.

BACKGROUND AND SUMMARY OF THE INVENTION

The referenced patent application discloses a leak detection system that employs a differential flow sensing principle for detecting fuel vapor leakage from the evaporative emission system of an automotive vehicle during a leakage test that involves closing the canister purge solenoid (CPS) valve and then positively pressurizing that portion of the evaporative emission system that is upstream of the CPS valve relative to the engine. One of the significant advantages of that leak detection system is that it less complicated, and hence more economical and reliable, than prior systems not using the differential flow sensing principle.

While the present invention also utilizes a differential flow sensing principle, it does so in a new and unique way that is less influenced by certain variables, such as ambient temperature, pressure, engine manifold vacuum, or supply voltage. Accordingly, a leak detection system embodying principles of the present invention possesses potential for improved accuracy and for avoiding false readings that might otherwise arise on account of such variables. More specifically, the inventive leak detection system is capable of canceling out effects of three external variables by comparing the leakage flow with a known calibrated reference leakage. The inventive leak detection system also eliminates the need for a relatively expensive pressure transducer used in prior non-differential flow sensing systems to detect pressure decay. It also does not require a canister vent valve used in such prior systems.

Another aspect of the invention relates to the physical integration of certain components of the leak detection system with a fuel vapor collection canister. This aspect provides greater spatial economy (i.e. more compactness) so that when the integrated canister/system is installed in an automotive vehicle, a smaller amount of space is taken up. This savings in space is especially important to many automobile manufacturers, who must build vehicles that comply with both applicable evaporative emission laws and regulations and applicable fuel economy laws and regulations. The integration possesses the further advantage of requiring fewer connections of components in the automotive assembly plant, and this affords the opportunity for installation cost savings while at the same time an opportunity for increased reliability of the installation.

Still another advantage of the invention is that a fuel vapor leak detection test can be performed either when the engine is running or not running.

The foregoing, along with further features, advantages, and benefits of the invention, will be seen in the ensuing description and claims, which are accompanied by drawings. The drawings disclose a presently preferred embodiment of the invention according to the best mode contemplated at this time for carrying out the invention.

DESCRIPTION OF THE PREFERRED EMBODIMENT

Figure 1:
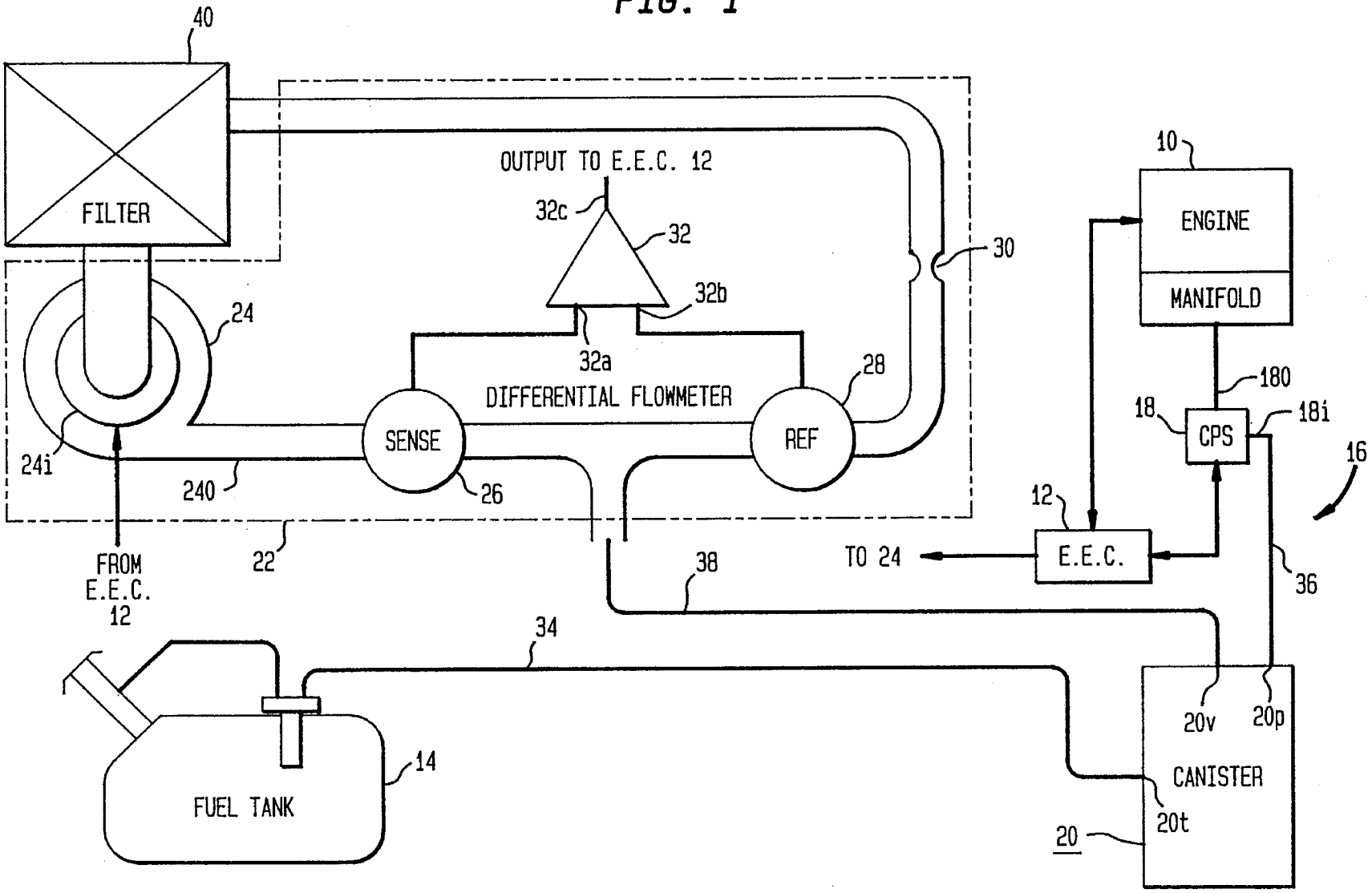
FIG. 1 is a schematic diagram of a fuel vapor leak detection system embodying principles of the invention.

FIG. 1 shows an exemplary application of the inventive principles to an automotive vehicle that is powered by an internal combustion engine 10 that is controlled by an electronic engine control 12. The vehicle comprises a fuel tank 14 for storing a volatile fuel such as gasoline that is vaporized and combusted in the engine's combustion chamber space.

The associated evaporative emission control system is designated generally by the reference numeral 16 and comprises: the usual canister purge solenoid (CPS) valve 18 having inlet and outlet ports **18*i* and 18*o* respectively; and a vapor collection canister (sometimes called a charcoal canister) 20 having a tank port 20*t*, a vent port 20*v*, and purge port 20*p***.

The leak detection system embodying principles of the invention is shown generally at 22 and comprises a pressure source 24, in the form of a device (preferably electrically operated, but alternatively operable by a mechanical input) that, when operated during a test, is capable of pressurizing the evaporative emission space under test, and that, when not being operated, provides venting of the canister vent port to atmosphere. An example of such a device 24 is an electric motor driven impeller pump having an inlet **24*i* and an outlet 24*o***.

Leak detection system 22 further comprises a series flow path comprising a first flow sensor 26, a second flow sensor 28, and a calibrated orifice 30 in that order. Flow sensors 26, 28, in cooperation with a differential amplifier 32, form a differential flow sensor for sensing the difference in flow through the respective flow sensors. An exemplary device that can be used for each flow sensor is a thermistor, with the two thermistors being connected in electric circuitry that is connected to respective inputs **32*a*, 32*b* of differential amplifier 32. Amplifier 32 functions to take the difference between the two flows through the respective flow meters and provide at its output 32*c*, an output signal that is indicative of the flow differential. This output signal is delivered to engine control 12**, which is a conventional processor programmed to conduct a leak detection test, in addition to controlling other engine functions, including possibly other types of diagnostic tests.

Canister tank port **20*t* is coupled with headspace of tank 14 via a conduit 34; purge port 20*p* is coupled with inlet port 18*i* of CPS valve 18 via a conduit 36; and vent port 20*v* is coupled with leak detection system 22 via a conduit 38 that forms a branch circuit that tees into the aforementioned series flow path at a location between the two flow sensors. Outlet port 18*o* of CPS valve 18 is coupled to the intake manifold vacuum that is produced by engine 10** when running.

When no leakage test is being performed, CPS valve 18 is operated by engine control 12 to periodically purge the vapor stored in canister 20 to the engine. The exact scheduling of such purging is controlled by the vehicle manufacturer's requirements.

When a leak detection test is to be conducted on the evaporative emission control system, CPS valve 18 is operated closed by control 12, and pressure source 24 is operated to beginning drawing outside air through a filter 40 and begin pressurizing that portion of the evaporative emission space comprising tank 14, conduit 34, canister 20, conduit 38, and conduit 36 up to the closed CPS valve. Naturally the vehicle tank filler cap must be in place to close the tank filler tube.

The series flow path formed by the two sensors 26, 28 and calibrated orifice 30 conducts all or a portion of the flow from pressure source 24 back to atmosphere through filter 40. Once pressure source 24 has been operated long enough to build the pressure inside the evaporative emission space being tested to a predetermined positive pressure relative to atmosphere, a leakless evaporative emission space, as defined above, will result in no flow through the branch conduit 38, while the entire flow from device 24 will pass through the series flow path composed of the two flow sensors and calibrated orifice. Under this condition, equal signals will be input to differential amplifier 32 so that a signal indicative of no leakage will be given by the amplifier for logging in memory of control 12.

On the other hand, if there is some leakage from the defined evaporative emission space once the pressure source has been operated long enough to build the pressure to a desired predetermined positive pressure relative to atmosphere, then some portion of the flow out of device 24 will flow through branch conduit 38 after having passed through sensor 26 in accompaniment of the remainder that proceeds to pass through sensor 28 and orifice 30. Since the flow through sensor 28 and orifice 30 will now be less than the flow through sensor 26, a difference in input signals will be detected by differential amplifier 32 and a corresponding leakage signal will be given to control 12 for logging in its memory. If the signal is larger than a predefined value, it indicates the presence of unacceptable leakage; a lesser signal indicates the absence of unacceptable leakage.

The broken line that bounds leak detection system 22 in FIG. 1 is intended to show that the various components within its confines can form an assembly that directly mounts on the top of canister 20. Such a physical integration of components provides more compactness for a canister/leak detection system and requires fewer connections of components in an automotive assembly plant, affording the opportunity for installation cost savings while at the same time an opportunity for increased installation reliability.

While a presently preferred embodiment of the invention has been illustrated and described, it is to be appreciated that the principles may be practiced in other equivalent ways within the scope of the following claims.

What is claimed is:

1. In an engine-powered automotive vehicle evaporative emission control system wherein a fuel tank for storing volatile fuel that is combusted in combustion chamber space of the engine is operatively associated with a fuel vapor collection canister that collects volatized fuel from the tank and a canister purge valve that is periodically operated to purge collected vapor from the canister to the engine, and leak detection system is operatively associated with the evaporative emission control system for detecting leakage from that portion of the evaporative emission control system which is upstream of an inlet of the canister purge valve relative to the engine, the improvement in said leak detection system which comprises:

pressurizing means having an inlet at which a source of gaseous medium is available to be pressurized by said pressurizing means and an outlet at which positively pressurized medium is made available for delivery to said portion of the evaporative emission control system;

a series flow path from said outlet of said pressurizing means back to said source of gaseous medium, said series flow path comprising a first flow sensor for sensing the entire flow from said outlet of said pressurizing means, a second flow sensor for sensing flow through a portion of said series flow path that is downstream of said first low sensor and a calibrated orifice means also disposed in said portion of said series flow path that is downstream of said first flow sensor;

a branch flow path that branches to said portion of said evaporative emission control system from said series flow path at a location in said series flow path that is between said first flow sensor and said second flow sensor; and means for sensing differential between flow sensed by said first flow sensor and flow sensed by said second flow sensor.

2. The improvement set forth in claim 1 in which said pressurizing means comprises an electrically operated impeller pump.

3. The improvement set forth in claim 2 in which said electrically operated impeller pump is physically mounted on said canister.

4. The improvement set forth in claim 2 in which said electrically operated impeller pump, when not being operated, serves to provide a vent from said evaporative emission control system to said source of gaseous medium.

5. The improvement set forth in claim 2 in which said electrically operated impeller pump, when not being operated, serves to provide a vent from said first flow sensor to said source of gaseous medium.

6. The improvement set forth in claim 5 including a filter through which said electrically operated impeller pump, when not being operated, serves to provide a vent from said evaporative emission control system by way of said first flow sensor to said source of gaseous medium.

7. The improvement set forth in claim 6 in which said source of gaseous medium is atmospheric air.

8. The improvement set forth in claim 1 including a filter through which said pressurizing means, when not being operated, serves to provide a vent from said evaporative emission control system to said source of gaseous medium.

9. The improvement set forth in claim 1 in which said means for sensing differential between flow sensed by said first flow sensor and flow sensed by said second flow sensor comprises a differential amplifier.

10. In an engine-powered automotive vehicle evaporative emission control system wherein a fuel tank for storing volatile fuel that is combusted in combustion chamber space of the engine is operatively associated with a fuel vapor collection canister that collects volatized fuel from the tank and a canister purge valve that is periodically operated to purge collected vapor from the canister to the engine, and leak detection system is operatively associated with the evaporative emission control system for detecting leakage from that portion of the evaporative emission control system which is upstream of an inlet of the canister purge valve relative to the engine, the improvement in said leak detection system which comprises:

means for creating a certain pressure in said portion of the evaporative emission control system for enabling a leakage test to proceed;

a series flow path extending between an inlet port and an outlet port of said means that are exposed to a common pressure, said series flow path comprising a first flow sensor for sensing the entire flow from one of said ports, a second flow sensor for sensing flow through a portion of said series flow path that is downstream of said first flow sensor and a calibrated orifice means also disposed in said portion of said series flow path that is downstream of said first flow sensor;

a branch flow path that branches to said portion of said evaporative emission control system from said series flow path at a location in said series flow path that is between said first flow sensor and said second flow sensor; and means for sensing differential between flow sensed by said first flow sensor and flow sensed by said second flow sensor.

11. The improvement set forth in claim 10 in which said means for creating a certain pressure in said portion of the evaporative emission control system for enabling a leakage test to proceed comprises a pump for developing positive pressure in said portion of the evaporative emission control system.

* * * * *